343-700 MS AU 251 EX
2/3/87 XR 4,641,006

United States Patent [19]

Ross et al.

[11] Patent Number: 4,641,006

[45] Date of Patent: Feb. 3, 1987

[54] ROTATING ANTENNA FOR A MICROWAVE OVEN

[75] Inventors: Frank E. Ross; William H. Hunter, both of Newton, Iowa

[73] Assignee: The Maytag Company, Newton, Iowa

[21] Appl. No.: 781,797

[22] Filed: Sep. 30, 1985

[51] Int. Cl.[4] ..... H05B 6/72

[52] U.S. Cl. ..... 219/10.55 F; 343/700 MS; 343/795

[58] Field of Search ..... 219/10.55 F, 10.55 R, 219/10.55 E; 343/700 MS, 793, 795, 803, 804, 806

[56] References Cited

U.S. PATENT DOCUMENTS

| | | | |
|---|---|---|---|
| 4,176,266 | 11/1979 | Kaneko et al. | 219/10.55 F |
| 4,284,868 | 8/1981 | Simpson | 219/10.55 F |
| 4,421,968 | 12/1983 | Osepchuk | 219/10.55 F |
| 4,436,973 | 3/1984 | Ikeda et al. | 219/10.55 F |
| 4,556,772 | 12/1985 | McCammon et al. | 219/10.55 F |

*Primary Examiner*—Philip H. Leung
*Attorney, Agent, or Firm*—Richard L. Ward

[57] ABSTRACT

A rotating antenna is provided for use in a microwave oven having drive apparatus for rotating the antenna, a heating cavity, a source of microwave energy and a waveguide between the heating cavity and the source of microwave energy. A probe extends into the waveguide for coupling with the microwave energy and is connected to a center-fed dipole radiator in the heating cavity. Radiation modifying elements are integral with the dipole radiator to provide increased radiation in the central portion of the heating cavity. Impedance balancing elements are also integral with the dipole radiator and cooperate with the probe to effectively match the impedance of the source of microwave energy with the impedance of the heating cavity to permit substantially full microwave power to be delivered to a cooking load.

3 Claims, 6 Drawing Figures

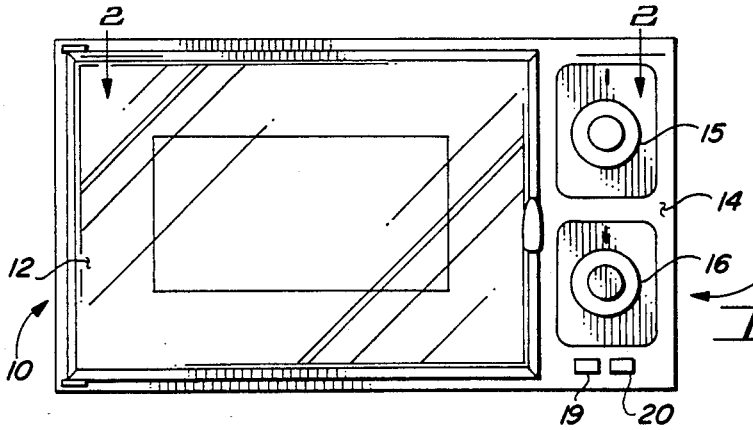
FIG. 1
FIG. 3
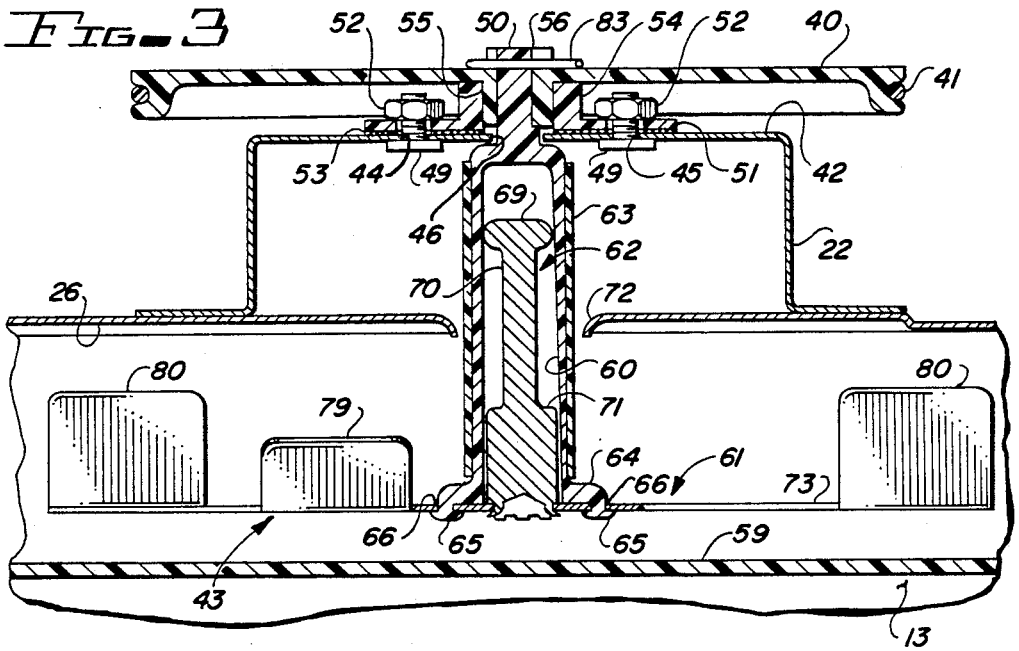
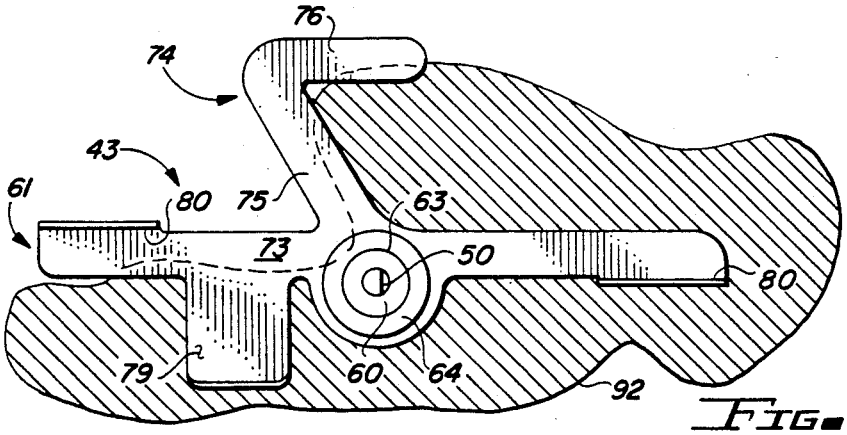
FIG. 6

ROTATING ANTENNA FOR A MICROWAVE OVEN

BACKGROUND OF THE INVENTION

This invention relates generally to the field of microwave ovens and in particular to an improved rotating antenna system therefor.

In the field of microwave ovens, several methods have been used in attempting to achieve satisfactory distribution of microwave energy within the oven cavity. Some manufacturers have utilized so-called "reflective mode stirrers". With the "reflective mode stirrers", a reflective multi-bladed rotatable stirrer element is placed in the path of the incoming microwave energy and the stirrer is rotated either by directing a flow of air toward the blades or by a separate drive motor. The microwave energy is randomly deflected by the blades and is thus randomly distributed within the oven cavity. Microwave ovens which utilize mode stirrers often also use turntables for rotating the food during cooking so that the operator does not have to interrupt operation of the oven to manually reposition the food. The use of a turntable does result in substantial added cost to the manufacturer.

Another well known method of distributing microwave energy within the oven cavity and toward the food has been the use of a rotating antenna. One example of such an antenna is described in U.S. Pat. No. 4,284,868 issued on Aug. 18, 1981 to James E. Simpson. Simpson, in '868, discloses a 2×2 planar array of ½ wavelength radiators suspended below the top of the oven cavity and rotated by airflow circulated through the oven cavity.

Another example of a rotating antenna for a microwave oven is shown in U.S. Pat. No. 4,421,968 issued to John M. Osepchuk on Dec. 30, 1983. Osepchuk in '968 discloses an antenna which includes conductive strips positioned parallel to and less than ¼ wavelength from an adjacent wall to reduce or eliminate radiation therefrom. Osepchuk '968 also provides a plurality of radiating elements at the ends of the conductive strips directed away from the adjacent wall for directing radiant energy toward the food load.

The prior art has thus included several constructions attempting to maximize the available microwave energy reaching the food load. These various methods have included mode stirrers for reflecting microwave energy and distributing it in a random manner, the use of a turntable with or without a mode stirrer in an attempt to eliminate manual turning of the food load, and rotating antennas for directing microwave energy toward the food load. There has been, however, no known showing of a rotating antenna system which utilizes a radiating center-fed dipole element having radiation modifiers for increasing the intensity of the microwave energy at the center of the oven cavity and for ensuring that the microwave energy extends uniformly outward from the center of the antenna as it rotates. The rotating antenna of the present invention further includes impedance balancing members associated with the dipole radiator for effectively matching the impedance of the source of energy with the impedance of the heating cavity.

SUMMARY OF THE INVENTION

It is therefore an object of the instant invention to provide an improved rotating antenna for a microwave oven.

It is a further object of the instant invention to provide a center-fed rotating antenna for providing substantially uniform energy distribution within a microwave oven cavity.

It is a still further object of the instant invention to provide a rotating antenna for increasing the intensity of microwave energy at the center of the microwave oven cavity and to reduce the need for manual turning of the food.

Briefly, the instant invention achieves these objects in a rotating antenna for use in a microwave oven having drive apparatus for rotating the antenna, a heating cavity, a source of microwave energy and a waveguide therebetween. A probe extends into the waveguide for coupling with the source of microwave energy. A center-fed dipole radiator is disposed in the heating cavity and is connected to the probe. At least one radiation modifier on the dipole radiator modifies the radiation pattern from the dipole radiator to provide increased radiation in the central portion of the heating cavity. Impedance balancing apparatus includes members on the dipole radiator cooperable with the probe for effectively matching the impedance of the microwave energy source with the impedance of the heating cavity to permit substantially full microwave power to be delivered to a cooking load.

Details of the rotating antenna and further objects and advantages thereof will become evident as the description proceeds and from an examination of the accompanying three sheets of drawings.

BRIEF DESCRIPTION OF THE DRAWINGS

The drawings illustrate a preferred embodiment of the invention with similar numerals referring to similar parts throughout the several views, wherein:

FIG. 1 is a front view of a typical microwave oven showing the access door and the various controls;

FIG. 3 is shown out of order on page 1 of the drawings and is a fragmentary section view taken generally along lines 3—3 of FIG. 2 showing a cross section of the waveguide and the antenna mounting structure;

FIG. 6 is also shown out of order on page 1 of the drawings and is a top view of the antenna of FIGS. 3 and 4 showing the radiation pattern emitted by the antenna.

DESCRIPTION OF A PREFERRED EMBODIMENT

Figure 2:
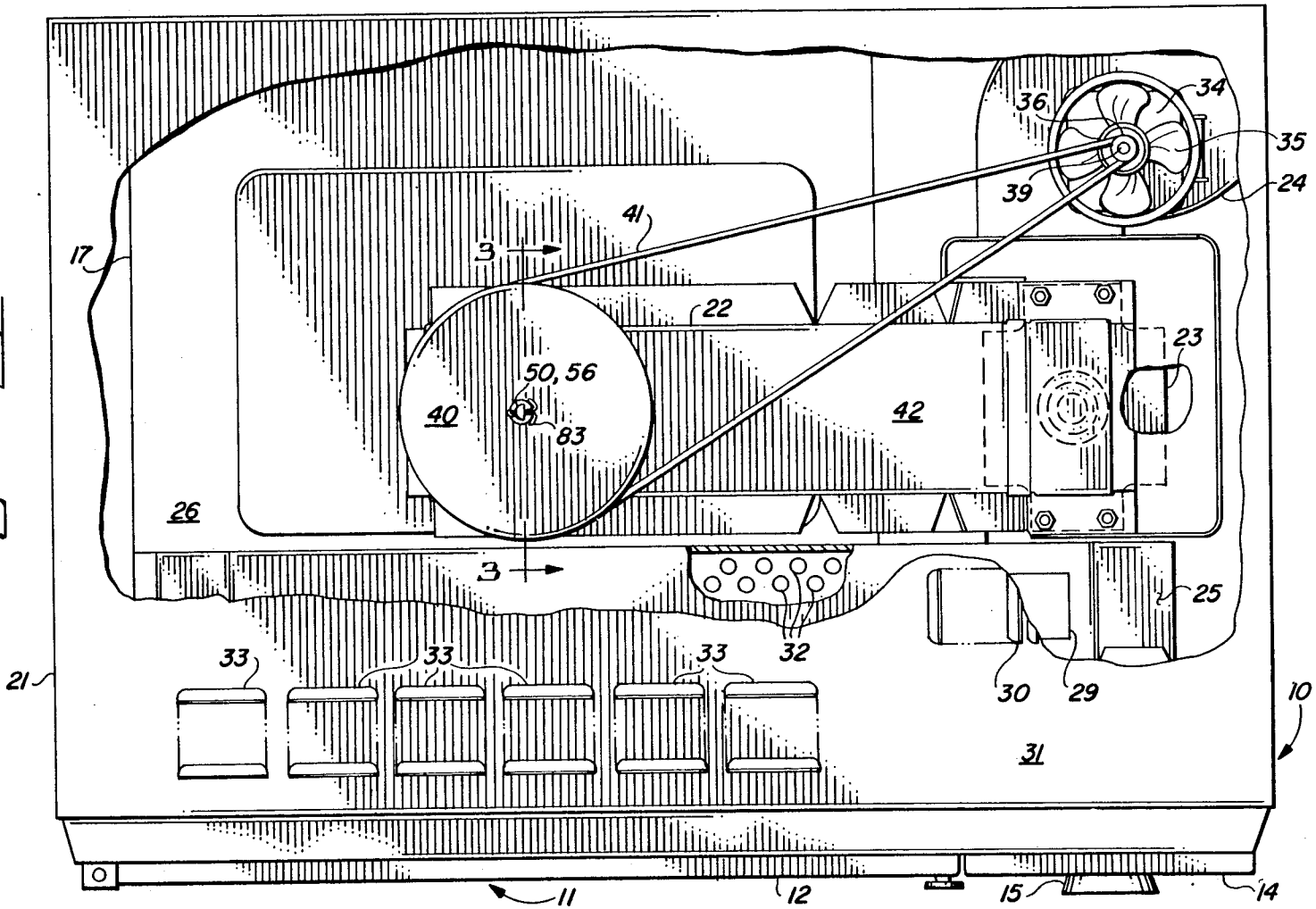
FIG. 2 is a plan view of the microwave oven taken generally along lines 2—2 of FIG. 1 with the sheet metal outer wrapper of the microwave oven broken away to show the cavity waveguide construction and the antenna drive system.

Turning now to the drawings and in particular to FIGS. 1 and 2, there is shown a microwave oven 10. The front surface 11 of the microwave oven 10 includes a vertically oriented door 12 which is hinged at the left as shown in FIGS. 1 and 2 and which closes an access opening (not shown) to the interior of the microwave oven cavity or enclosure 13. As best shown in FIG. 1, the right-hand side of the front surface 11 of the microwave oven 10 includes a control panel 14 housing controls such as a timer 15, power level setting control 16 and on-off switches 19 and 20. These manual controls 15 and 16 are shown for purposes of illustration only since it is well known that a variety of touch controls are available and in use in the industry.

In FIG. 2 the outer wrapper 21 of the microwave oven 10 has been partially removed to show some of the internal structure. The microwave oven cavity 13 is generally rectangular in shape with inside dimensions of approximately 15⅜ inches wide by 16 inches deep and 10¾ inches high or about 1½ cubic feet. The oven cavity 13 is constructed of a conductive material such as sheet steel which is then painted to provide a protective and pleasing appearance. A three-sided generally rectangular waveguide 22 is also constructed of sheet steel and extends from approximately the center of the top of the oven cavity 13 and to the right side of the oven cavity 13 as viewed in FIG. 2. A magnetron 23 provides a source of microwave energy to be fed through the waveguide 22 and into the oven cavity 13 and is located on the right side of the oven cavity 13 directly behind the control panel 14.

As further shown in FIG. 2, a centrifugal blower 24 is positioned for directing cooling air across the magnetron 23. The cooling air is captured by an air duct 25 on the side of the magnetron 23 opposite the centrifugal blower 24. The air duct 25 extends substantially across the top wall 26 of the oven cavity 13 and includes a rectangular aperture 29 which is in airflow registration with a first plurality of louvers 30 in the top 31 of the outer wrapper 21 for directing a portion of the cooling air to atmosphere. The remaining portion of the cooling air is directed into the oven cavity 13 through a plurality of apertures 32 in the top wall 26 of the oven cavity 13 and is routed through the oven cavity 13 and exhausted through a second plurality of louvers 33 in the top 31 of the outer wrapper 21.

The drive motor 34 for the centrifugal blower 24 includes a combination cooling fan 35 and an auxiliary drive pulley 36 drivingly associated with an upward extension of the drive shaft 39. The auxiliary drive pulley 36 is further drivingly connected to a driven pulley 40 through a circular cross section stretch belt 41. The driven pulley 40 is sized for a rotational speed of approximately 200 revolutions per minute.

Turning now to FIG. 3, there is shown the mounting or attachment of the driven pulley 40 to the top wall 42 of the waveguide 22 and the mounting of the rotating antenna 43 to the driven pulley 40. As best shown in FIG. 3, the top wall 42 of the waveguide 22 includes a trio of apertures 44–46. A pair of these apertures 44 and 45 receive a pair of upwardly extending threaded weld screws 49 and the third center aperture 46 serves as a clearance hole for a D-shaped upper shaft portion 50 of the rotating antenna 43.

As further shown in FIG. 3, a mounting block 51 for the driven pulley 40 is attached to the top wall 42 of the waveguide 22 over the pair of upwardly extending threaded weld screws 49. A pair of threaded fasteners 52 engage with the threaded weld screws 49 for securing the mounting block 51 in the posture of FIG. 3. A metallic mesh gasket 53 is sandwiched between the top wall 42 of the waveguide 22 and the mounting block 51 to prevent leakage of microwave energy at that junction. The mounting block 51 includes a generally centrally located upwardly extending sleeve portion 54 which effectively journals a downwardly protruding hub 55 associated with the driven pulley 40. The hub 55 of the driven pulley 40 includes a D-shaped aperture 56 for receiving a D-shaped upper shaft portion 50 of the rotating antenna 43 and which will be further described herein.

Also shown in FIG. 3 is a shield 59 formed of thermoplastic material and located between the rotating antenna 43 and the food to be cooked. The shield 59 prevents interference between the rotating antenna 43 and large food items and protects the upper areas of the oven cavity 13 from grease splatters. A further function of the shield 59 is to direct cooling air from the apertures 32 toward the rear of the oven cavity 13.

Figure 4:
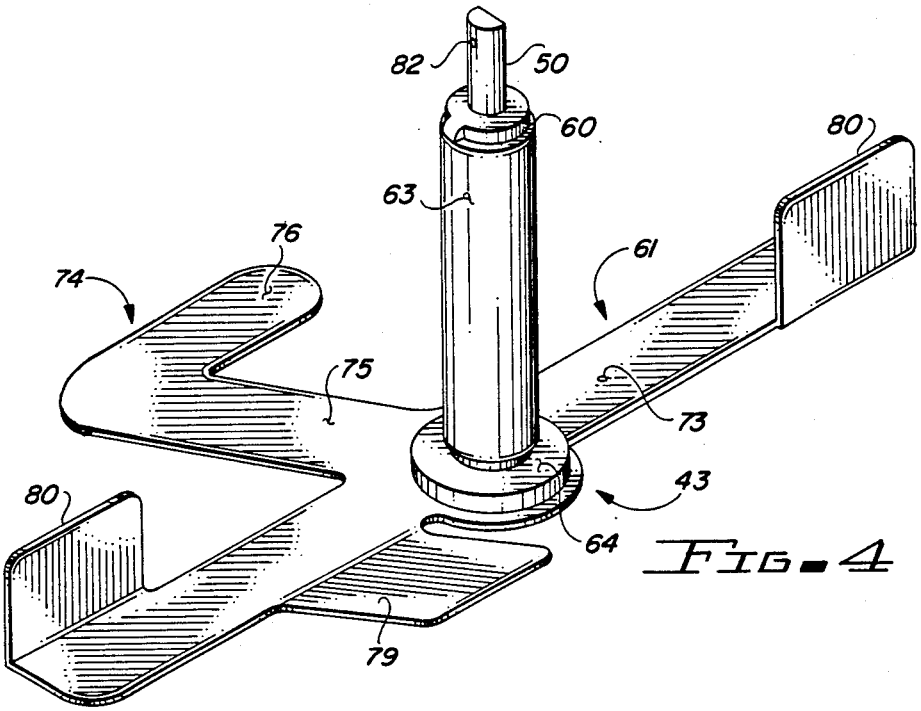
FIG. 4 is an isometric view of the antenna shown in FIG. 3.

Turning now to FIGS. 3 and 4, the rotating antenna 43 is made up of several individual components including an isolator shaft 60, an antenna body 61, a probe 62 and a sleeve 63. The isolator shaft 60 is a substantially hollow cylindrical member molded of a dielectric thermoplastic material. One end of the isolator shaft 60 is open and includes a flange 64 having a pair of circular pins 65. The opposite end of the isolator shaft 60 includes the D-shaped upper shaft portion 50 which mates with the D-shaped aperture 56 in the hub 55 of the driven pulley 40. The circular pins 65 associated with the flange 64 extend through a pair of apertures 66 in the antenna body 61. The circular pins 65 are enlarged or upset as by heat staking to secure the isolator shaft 60 to the antenna body 61.

Prior to assembling the isolator shaft 60 to the antenna body 61, the probe 62 must be mechanically fastened thereto. The aluminum probe 62 is cylindrical in configuration with a bulbous upper portion 69 and a reduced diameter center section 70. The lower portion 71 of the probe 62 is mechanically staked to the antenna body 61 as best shown in FIG. 3. The bulbous portion 69 of the probe 62 extends into the hollow portion of the isolator shaft 60 and when the rotating antenna 43 is in the operable posture of FIG. 3 the probe 62 extends through a downwardly extruded opening 72 in the top wall 26 of the oven cavity 13 and protrudes into the waveguide 22 a distance for optimum reception of microwave energy. The downwardly extruded opening 72 helps to suppress arcing between the probe 62 and the top wall 26 of the oven cavity 13.

In a preferred embodiment of the rotating antenna 43, the antenna body 61, as shown in FIGS. 3 and 4, is formed from sheet aluminum. The antenna body 61 includes a radially extending, generally rectangular, center-fed dipole element 73 approximately 1/32 inch thick by ½ inch wide by 6¼ inches long and attached to the probe 62 as previously discussed. As best shown in FIGS. 4 and 6, the antenna body 61 further includes an end-fed element 74 having a ½ inch wide first portion 75 extending angularly outward at 60 degrees from the center-line of the dipole element 73 for approximately 25/16 inches in the same plane as the dipole element 73. A ½ inch wide second portion 76 of the end-fed element 74 is joined to the angularly extending first portion 75 and extends substantially parallel to the dipole element 73 for about 115/16 inches. The antenna body 61 also has an arm portion 79 angularly disposed at 22½ degrees from the plane of the dipole element 73. The arm portion 79 is located on the side opposite the end-fed element 74 and has a true length of 1¼ inches and a width of 31/32 inches. Each end of the dipole element 73 includes an upwardly extending lug 80 measuring approximately 1 inch wide by 51/64 inches high and generally perpendicular to the plane of the dipole element 73.

A sleeve 63 of fluorinated ethylene propylene (FEP) such as is available from Chemplast, Inc. as "Chemfluor FEP 100" is assembled over the outside of the isolator shaft 60 as shown in FIGS. 3 and 4 to provide a non-tracking surface in the event of contamination of the surface by foreign particles which could potentially cause the occurrence of localized arcing between the probe 62 and the waveguide 22.

As best shown in FIG. 3, the complete rotating antenna 43 is drivingly connected to the driven pulley 40 through the mating D-shaped shaft 50 and D-shaped aperture 56. The D-shaped shaft 50 of the isolator shaft 60 includes a transverse aperture 82 for receiving a cotter key 83, as shown in FIGS. 2 and 3, for locking the rotating antenna 43 to the driven pulley 40.

Figure 5:
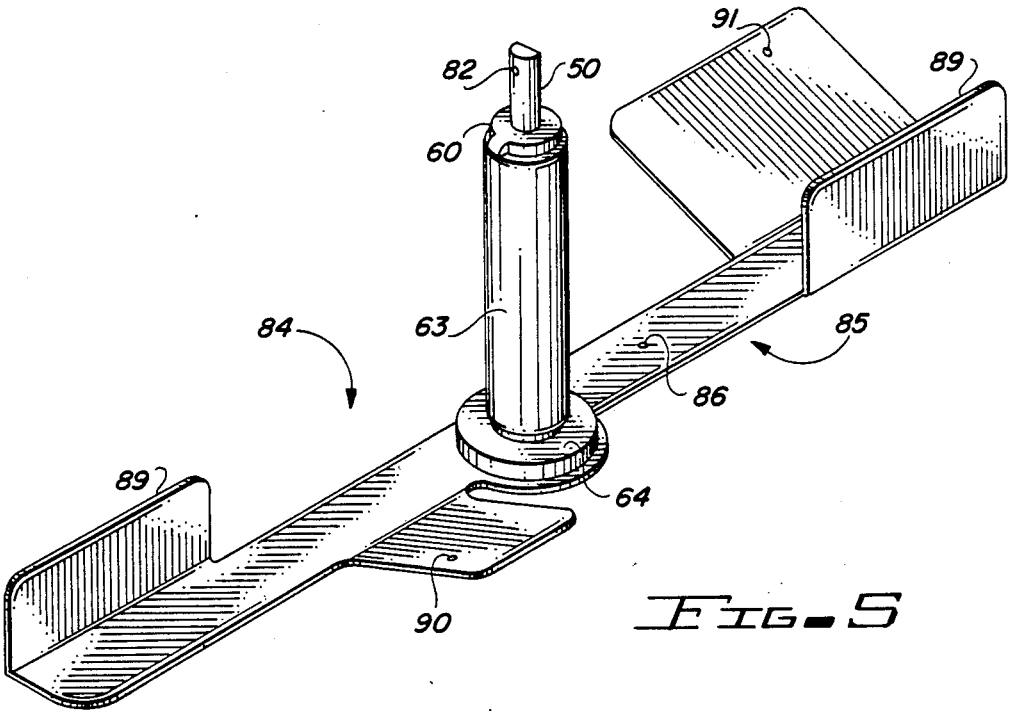
FIG. 5 is an isometric view of an alternate embodiment of the antenna.

FIG. 5 depicts an alternate embodiment of the rotating antenna 43. In this embodiment of the antenna 84, the antenna body 85 is again formed from 1/32 inch thick by ½ inch wide sheet aluminum and again includes a center-fed dipole element 86 attached to the probe in the manner of FIG. 3. This embodiment includes a pair of upwardly extending lugs 89 at the ends of the dipole element 86 similar to but slightly wider than those shown in the rotating antenna 43 of FIGS. 3 and 4. The antenna body 85 also includes a first angularly disposed arm portion 90 identical to that utilized in the rotating antenna 43 of FIGS. 3 and 4 and disposed at 22½ degrees with respect to the plane of the dipole element 86. This alternate embodiment antenna 84 further includes a second angularly disposed arm portion 91 which measures approximately 1¾ inch in width by 1¼ inch in true length and is located on the side of the dipole element 86 opposite the first angularly disposed arm portion 90. The second angularly disposed arm portion 91 is located at one end of the dipole element 86 directly opposite one of the upwardly extending lugs 89 and extends upwardly at 22½ degrees with respect to the plane of the dipole element 86 as best shown in FIG. 5.

There have been shown herein preferred and alternate embodiments of a rotating antenna 43 or 84. During the process of developing the rotating antenna 43 or 84 several configurations having minor variations in size and shape were tested which fall within the boundaries defined by the instant invention.

Referring again to FIGS. 3–5, when one of the antennas 43 or 84 of FIGS. 4 and 5 are operably mounted to the driven pulley 40 as shown in FIG. 3, the plane of the center-fed dipole element 73 or 86 is spaced slightly further than ¼ of the wavelength of the microwave energy being used from the top wall 26 of the oven cavity 13 which acts as a fixed ground plane. In the preferred embodiment of the invention, a wavelength of microwave energy is defined as 4.820 inches per cycle so that ¼ wavelength equals 1.205 inches and ⅛ wavelength equals 0.602 inches. It has been found that this spacing of the dipole element 73 from the top wall 26 will permit the dipole element 73 or 86 to radiate microwave energy along its length. If the dipole element 73 or 86 is spaced less than ¼ wavelength from the top wall 26, it has been found that the dipole element 73 or 86 will behave more like a transmission line than a radiator. The ends of the angularly disposed arms 79, 90 and 91 of the rotating antennas 43 and 84 shown in FIGS. 4 and 5 are spaced more than ⅛ wavelength but less than ¼ wavelength from the ground plane of the top wall 26. These arms 79, 90 and 91 serve as radiation modifiers for the radiation emitted from the dipole element 73 or 86 and it has been found by experimentation that this spacing produces the most desirable radiation modifying effect. In the preferred embodiment of FIG. 4 and in the alternate embodiment of FIG. 5, the respective combinations of end-fed element 74 with arm portion 79 in the rotating antenna 43 and arm portions 90 and 91 in the rotating antenna 84 serve as radiation modifiers for the radiation emitted from the dipole element 73 or 86. This produces a radiation pattern in either embodiment which is more intense at the center of the antenna 43 or 84. The antenna modifications exhibited by the alternate embodiment of FIG. 5 were necessary to achieve operating characteristics similar to those of the preferred embodiment in an oven cavity which has been altered in one of the primary dimensions.

The upper edge of the upwardly extending lugs 80 or 89 at the ends of the dipole element 73 or 86 are spaced a distance less than ⅛ wavelength from the ground plane of the top wall 26. These lugs 80 or 89 are impedance matching elements and help balance the impedance of the magnetron 23 to the impedance of the oven cavity 13. Or, in other words, these lugs 80 or 89 help assure that the power output of the magnetron 23 substantially equals the power input to the food being cooked.

FIG. 6 illustrates the radiation pattern emitted by the antenna 43 in FIGS. 3 and 4. In FIG. 6, the cross-hatched area generally represents the instantaneous radiation pattern 92 of this antenna 43 at any given angle of rotation. The radiation output pattern 92 of FIG. 6 was obtained by the following procedure: (1) the drive belt 41 was disconnected from the driven pulley 40, (2) a paper blotter soaked in cobalt chloride was mounted 3/16 of an inch below the bottom of the dipole element 73 of the rotating antenna 43, (3) the microwave oven 10 was then energized for one minute to irradiate the cobalt chloride soaked blotter, and (4) the procedure of Steps 1–3 was repeated at 45° intervals of rotation of the rotating antenna 43 to plot the entire 360° rotational path. The radiation pattern 92 shown in FIG. 6 represents an average of the readings taken at 45° intervals for 360° of rotation. The radiation pattern 92 illustrates the pattern rotated about the vertical centerline of the rotating antenna 43 and directed downwardly toward the food being cooked. Though not shown, the radiation pattern emitted by and rotated about the vertical center line of the alternate embodiment of the antenna identified by numeral 84 in FIG. 5 similarly provides increased power output at the center of the oven cavity 13.

Referring again to FIG. 6, it can be seen that the dipole element 73 emits radiation substantially along its entire length. The end-fed element 74 in FIG. 6 effectively radiates along its length and especially between its second portion 76 and the parallel dipole element 73. It is noted that there is effectively no radiation in the quadrant behind the end-fed element 74. The angularly disposed arm portion 79 on the opposite side of the dipole element 73 combines with the end-fed element 74 to effectively shift the radiation so that it is more intense at the center of the rotating antenna 43. Thus, the radiation pattern 92 is made slightly non-uniform to provide more power input to the center of the oven cavity 13 immediately below the rotating antenna 43.

It is noted that with the rotating antenna 43 the downwardly directed radiation pattern 92 will effectively sweep or cover the entire microwave oven cavity 13 as the antenna 43 is rotated at approximately 200 revolutions per minute. The somewhat non-uniform pattern 92 developed by this rotating antenna 43 provides for increased power input at the center of the oven cavity 13 while maintaining adequate power radially outward from the center of the oven cavity 13 to ensure uniform cooking without requiring manual turning of the food.

During operation of the preferred embodiment, energy from the magnetron 23 having a frequency of about 2450 megahertz is propagated through the waveguide 22. The end of the waveguide 22 is impedance matched to the probe 62 extending into the waveguide 22. Final impedance balancing of the oven cavity 13 to the magnetron 23 is provided by the upwardly extending lugs 80 of the antenna body 61. The probe 62 receives the microwave energy in the waveguide 22 and conducts that microwave energy into the oven cavity 13. The microwave energy is then radiated along the length of the dipole element 73 subject to modification by elements such as the end-fed element 74 and the angularly disposed arm portion 79 as previously discussed.

There has thus been described herein an improved rotating antenna for a microwave oven. This improved antenna provides for radiation substantially along the entire length of a dipole element which is subject to modification by various radiation modifying elements. The improved radiation pattern of this rotating antenna provides for more intense radiation at the center of the oven cavity directly below the antenna and also provides for a substantially uniform radiation pattern extending radially outward from the center of the oven cavity as the antenna rotates. The rotating antenna thus provides for more uniform cooking within the oven cavity without requiring manual turning of the item being cooked except in extreme cases.

In the drawings and specification, there is set forth a preferred embodiment of the invention and although specific terms are employed these are used in a generic and descriptive sense only and not for purposes of limitation. Changes in the form and the proportion of parts as well as the substitution of equivalents are contemplated as circumstances may suggest or render expedient without departing from the spirit or scope of the invention as defined in the following claims.

We claim:

1. A microwave oven, comprising: means including a plurality of walls defining a heating cavity, a source of microwave energy disposed outside of said heating cavity, a waveguide extending between said source of microwave energy and one wall of said means defining a heating cavity, a rotatable antenna disposed at least partially in said heating cavity and electrically insulated from said means defining a heating cavity and from said waveguide, and drive means for rotating said rotatable antenna, said rotatable antenna including receiver means in the form of a probe extending into said waveguide from said heating cavity at a position spaced from said source of microwave energy for receiving microwave energy therefrom, said rotatable antenna further including center-fed elongated sheet metal radiator means disposed in a plane within said heating cavity spaced from said one wall and electrically connected to said probe for conducting microwave energy therefrom and for radiating said microwave energy from along its length into said heating cavity, said rotatable antenna further including radiation modifying means comprising a sheet metal auxiliary radiating element formed integrally with and extending outwardly from said elongated radiator means, said auxiliary radiating element including a first portion connected to said elongated radiator means and extending outwardly in said plane at an acute angle to one end of said elongated radiator means and a second portion connected to said first portion and extending in said plane toward the other end of said elongated radiator means at an acute angle to said first portion, said radiation modifying means being operable for modifying the relative radiation from portions of said elongated radiator means and defining with said elongated radiator means a rotating radiation pattern providing increased radiation in the central portion as compared to the outer portions of said heating cavity, said rotatable antenna further including impedance balancing means for effectively matching the impedance of said source of microwave energy with the impedance of said heating cavity.

2. A microwave oven, comprising: means including a plurality of walls defining a heating cavity, a source of microwave energy disposed outside of said heating cavity, a waveguide extending between said source of microwave energy and one wall of said means defining a heating cavity, a rotatable antenna disposed at least partially in said heating cavity and electrically insulated from said means defining a heating cavity and from said waveguide, and drive means for rotating said rotatable antenna, said rotatable antenna including receiver means in the form of a probe extending into said waveguide from said heating cavity at a position spaced from said source of microwave energy for receiving microwave energy therefrom, said rotatable antenna further including center-fed elongated sheet metal radiator means disposed in a plane within said heating cavity spaced from said one wall and electrically connected to said probe for conducting microwave energy therefrom and for radiating said microwave energy from along its length into said heating cavity, said rotatable antenna further including end-fed sheet metal radiation modifying means integrally formed with said elongated radiator means and including a first portion connected to said probe and extending outwardly in said plane at an acute angle to one end of said elongated radiator means and a second portion connected to said first portion and extending in said plane toward the other end of said elongated radiator maans at an acute angle to said first portion, said end-fed radiation modifying means operable for modifying the relative radiation at said one end of said elongated radiator means, said rotatable antenna further including at least one angularly disposed arm integrally formed with said elongated radiator means and extending into the space between said plane and said one wall for further modifying the relative radiation along said elongated radiator means, said end-fed radiation modifying means and said angularly disposed radiation modifying arm with said elongated radiator means defining a rotating radiation pattern providing increased radiation in the central portion as compared to the outer portions of said heating cavity, said rotatable antenna further including impedance balancing means for effectively matching the impedance of said source of microwave energy with the impedance of said heating cavity.

3. A microwave oven as defined in claim 2 wherein the plane of said elongated radiator means of said rotatable antenna is more than $\frac{1}{4}$ wavelength from said one wall of said means defining a heating cavity and wherein the end of said angularly disposed arm is spaced more than $\frac{1}{8}$ wavelength but less than $\frac{1}{4}$ wavelength from said one wall.

* * * * *